US008402673B2

(12) United States Patent
Da Silva et al.

(10) Patent No.: US 8,402,673 B2
(45) Date of Patent: Mar. 26, 2013

(54) METHOD FOR DRYING A FIBROUS WEB

(75) Inventors: Luiz C. Da Silva, Campo Limpo (BR); Thomas Scherb, Sao Paolo (BR); Ronaldo Parucker, Sao Paulo (BR); Oswaldir Rizzatto, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 568 days.

(21) Appl. No.: 12/487,344

(22) Filed: Jun. 18, 2009

(65) Prior Publication Data

US 2009/0288311 A1 Nov. 26, 2009

Related U.S. Application Data

(63) Continuation of application No. PCT/EP2007/064308, filed on Dec. 22, 2006.

(30) Foreign Application Priority Data

Dec. 22, 2006 (DE) ..... 10 2006 062 235

(51) Int. Cl.
*D21F 5/06* (2006.01)

(52) U.S. Cl. ..... 34/444; 34/454; 162/206

(58) Field of Classification Search ..... 34/444, 34/451, 454, 471, 497; 162/205, 206
See application file for complete search history.

(56) References Cited

U.S. PATENT DOCUMENTS

| | | | | |
|---|---|---|---|---|
| 4,324,613 | A * | 4/1982 | Wahren | 162/111 |
| 5,033,207 | A * | 7/1991 | Sturm et al. | 34/115 |
| 5,399,241 | A * | 3/1995 | Oriaran et al. | 162/112 |
| 5,845,415 | A * | 12/1998 | Sundqvist | 34/452 |
| 5,921,000 | A * | 7/1999 | Wedel et al. | 34/117 |
| 6,732,453 | B2 * | 5/2004 | Norri | 34/444 |
| 7,691,228 | B2 * | 4/2010 | Edwards et al. | 162/111 |
| 7,811,414 | B2 * | 10/2010 | Sundqvist et al. | 162/198 |
| 7,943,012 | B2 * | 5/2011 | Backman et al. | 162/272 |
| 2003/0009905 | A1 * | 1/2003 | Norri | 34/454 |
| 2005/0155734 | A1 | 7/2005 | Hermans et al. | |
| 2009/0288311 | A1 * | 11/2009 | Da Silva et al. | 34/444 |

FOREIGN PATENT DOCUMENTS

| | | | |
|---|---|---|---|
| DE | 2802156 | B1 | 6/1979 |
| DE | 102006062235 | A1 * | 6/2008 |
| EP | 1852551 | A1 | 11/2007 |
| WO | 2005075737 | A1 | 8/2005 |

* cited by examiner

*Primary Examiner* — Stephen M. Gravini
(74) *Attorney, Agent, or Firm* — Taylor IP, P.C.

(57) ABSTRACT

A method for drying a fibrous web, especially a paper, cardboard or tissue web, the moving web is treated with hot air from a hot air hood in the area of a upstream pre-defined drying zone, and is subsequent carried to the drying zone in a downstream drying cylinder, especially a Yankee-Cylinder, to which an additional hood is allocated and in whose area the fibrous web is dried further. The hot air for the hot air hood allocated to the upstream drying zone is recovered, at least partially, from the exhaust air of the hood allocated to the downstream drying cylinder.

28 Claims, 4 Drawing Sheets

Steam Shower

Hot Air Hood

METHOD FOR DRYING A FIBROUS WEB

This is a continuation of PCT application No. PCT/EP2007/064308, entitled "METHOD AND APPARATUS FOR DRYING A FIBROUS MATERIAL WEB", filed Dec. 20, 2007, which is incorporated herein by reference.

BACKGROUND OF THE INVENTION

1. Field of the Invention

The invention relates to a method for drying a fibrous web, especially a paper, cardboard or tissue web. In addition it relates to a corresponding machine to produce a fibrous web, especially a paper, cardboard or tissue web.

2. Description of the Related Art

A method which serves to produce a voluminous tissue web and in which a so-called belt press, in conjunction with a hot air hood, or alternatively with a steam hood, is utilized for dewatering the fibrous web to a certain dry content, is already described in WO 2005/075737.

What is needed in the art is a tissue machine with reduced energy consumption, especially during the drying process to achieve a pre-determinable dry content. On the other hand, there is a requirement to increase the dry content at reduced energy consumption.

SUMMARY OF THE INVENTION

The current invention is an improved method, as well as an improved apparatus in which the drying process for the production of a tissue web is optimized, especially in consideration of the energy requirement for dewatering the tissue web.

With respect to the method the hot air for the hot air hood, which is allocated to the upstream drying zone is recovered at least partially from the hood allocated to the downstream drying cylinder.

The hot air for the hot air hood allocated to the upstream drying zone is recovered, at least partially, from the exhaust air of the hood allocated to the downstream drying cylinder.

Drying air from a separate drying air source can advantageously be supplied to the hot air hood allocated to the upstream drying zone, and this drying air supplied to the hot air hood can be heated especially by way of a heat exchanger with hot air which is recovered from the hood or its exhaust air, allocated to the drying cylinder.

By recovering the hot air for the hot air hood of the upstream drying zone at least partially from the hood or from the exhaust air of the hood allocated to the downstream drying cylinder, energy is correspondingly recovered. Energy recovery of this type is possible since the exhaust air temperature of the hood allocated, for example, to a Yankee-Cylinder is very much higher than the temperature which is necessary for the hot air to supply the hot air hood of the upstream drying zone. The temperature of the hot air recovered from the hood of a drying cylinder, especially a Yankee-Cylinder can be approximately 300° C.

Preferably, the hot air hood in the upstream dryer zone is supplied, at least partially, with hot air having a temperature of <250° C., especially <200° C. and preferably in a range of approximately 150° C. to approximately 200° C.

According to an embodiment of the present invention the fibrous web is treated with steam inside the drying zone, at least in some area. Accordingly, hot air and steam are used in combination together for drying the fibrous web, which may be a tissue web.

The fibrous web is advantageously treated with steam within the first half of the total drying zone length, when viewed in the direction of web travel. In this arrangement the fibrous web is treated with steam, at least at the beginning of the drying zone, when viewed in the direction of web travel.

Viewed in the web direction, the fibrous web is initially treated with steam and subsequently with hot air. According to an alternative practical arrangement it is possible to treat the fibrous web when viewed in the direction of web travel initially with hot air, subsequently with steam and then again with hot air.

In certain instances it is advantageous if the fibrous web, viewed in the direction of web travel is treated at least essentially over the entire length of the drying zone with steam.

According to another embodiment of the present invention it is possible to treat the fibrous web with steam, at least essentially only within the first half of the total length of the drying zone when viewed in the direction of web travel, whereby the fibrous web is treated with steam, preferably at least essentially over only the first half of the total length of the drying zone, viewed in the direction of web travel.

According to yet another embodiment of the present invention the fibrous web is treated with steam, at least essentially only within the first third of the total length of the drying zone, and moreover preferably substantially over this first third, viewed in the direction of web travel.

In certain cases it is also advantageous if the fibrous web is treated with steam, at least essentially only within the first quarter of the total length of the drying zone, and moreover hereby preferably substantially over this first quarter, viewed in the direction of web travel.

According to an additional alternative arrangement of the inventive method the fibrous web is treated with steam only at the beginning of the drying zone, viewed in the direction of web travel.

It is preferred if the fibrous web is treated with hot air over the pre-determinable drying zone. The drying zone is defined, at least essentially through the area in which the fibrous web is treated with hot air. In this case the fibrous web may be treated with steam, particularly inside and/or prior to this drying zone.

The fibrous web is advantageously treated, at least in some areas, simultaneously with hot air, as well as with steam, viewed in the direction of web travel. Under simultaneous treatment it is to be understood that a respective area of the fibrous web is treated with hot air, as well as also with steam.

According to another embodiment of the present invention the fibrous web is guided through the drying zone together with a permeable fabric, especially a structured fabric or a TAD-fabric (TAD=Through Air Drying). In this case, hot air or steam (as far as the stream has not condensed in the web) flow initially through the fibrous web, and subsequently through the permeable fabric. The inventive combined hot air and steam treatment can therefore also be used in a TAD drying process.

A preferred alternative arrangement of the inventive process distinguishes itself in that the fibrous web, together with at least one permeable fabric, especially a structured fabric is carried through the drying zone, whereby hot air or steam flow initially through the permeable fabric and subsequently through the fibrous web.

In the drying zone the fibrous web can be covered by at least one additional permeable fabric, especially a press fabric. In this case hot air or steam flow initially through the additional permeable fabric or press belt, subsequently through the first permeable fabric or structured fabric and finally through the fibrous web. Moreover, in the use of a press belt a type of belt press results through which, in addition to the mechanical pressure, the inventive combined hot air and steam drying is applied.

A dewatering fabric, especially a felt, can additionally be run through the drying zone together with the fibrous web. Hot air or steam, as far as has not condensed on the web, as previously mentioned, initially flow through the additional permeable fabric or press belt, subsequently through the first permeable fabric or structured fabric and the fibrous web and finally through the additional dewatering fabric.

It is also conceivable to subject the fibrous web in the drying zone, in at least some areas to impingement drying. In this scenario therefore, the inventive combined hot air and steam application is used within the scope of such an impingement drying.

The fibrous web may be subjected in the drying zone, in at least some areas, also to through-air drying.

An embodiment of the present invention provides a machine for the production of a fibrous web, especially a paper, cardboard or tissue web, including an upstream drying zone in which the moving fibrous web is treated with hot air from a hot air hood, and includes a downstream dryer cylinder, especially a Yankee-Cylinder with an allocated hood for further drying of the fibrous web. This machine is characterized in that the hot air for the hot air hood allocated to the upstream drying zone is recovered at least partially from the hood allocated to the downstream drying cylinder. The hot air for the hot air hood allocated to the upstream drying zone is preferably recovered, at least partially, from the exhaust air of the hood allocated to the downstream drying cylinder.

Drying air from a separate drying air source is advantageously supplied to the hot air hood allocated to the upstream drying zone. This drying air supplied to the hot air hood is heated especially by way of a heat exchanger with hot air which is recovered from the hood or its exhaust air, allocated to the drying cylinder.

As already mentioned, a corresponding energy recovery from the drying cylinder, or respectively its allocated hood, is possible since the temperature of the exhaust air of this hood is very much higher than the temperature necessary for the hot air to supply the hot air hood of the upstream drying zone. The temperature of the hot air recovered from the hood of a drying cylinder, specifically a Yankee-Cylinder, can be approximately 300° C. Preferably, the hot air hood in the dryer zone is supplied, at least partially, with hot air whose temperature is in a range of <250° C., especially <200° C. and preferably approximately 150° C. to approximately 200° C. The temperature of the hot air for the supply of the hot air hood can be accordingly adjustable and/or controllable for optimization of the operating point with regard to the energy consumption. As a rule, a higher temperature does not result in more efficient drying.

Preferably the fibrous web is treated with steam, at least in some areas within the drying zone. For the treatment of the fibrous web with hot air, preferably one hot air hood is provided. In this arrangement the drying zone is defined by the dimensions of the hot air hood. A steam treatment of the fibrous web is advantageously conceivable inside and/or before the drying zone.

At least one steam blow device, especially a steam blow pipe or steam blow box is advantageously provided for the treatment of the fibrous web with steam. The steam blow device extends at least essentially over the entire width of the hot air hood, measured across the direction of web travel. It is also especially advantageous if the steam blow device is located, at least partially, inside the hot air hood. According to one arrangement the steam blow device may also be located directly before the hot air hood, viewed in the direction of web travel. The steam blow device can be arranged, designed and/or controlled so that the fibrous web, viewed in the direction of web travel, is treated simultaneously with hot air as well as with steam over only a part of the total length of the drying zone or over the entire drying zone.

If the steam blow device includes a steam blow pipe, then the diameter of the orifice of this steam blow pipe is advantageously in a range of approximately 5 to approximately 1 mm, and preferably in a range of approximately 4 to approximately 2.5 mm. The diameter in question preferably has an upper limit, since a certain speed is necessary for the steam jet.

If the fibrous web is covered by at least one permeable fabric, for example a permeable press belt in the area of the drying zone, then the distance between the steam blow device and the outer permeable fabric covering the fibrous web is preferably <30 mm, especially <20 mm, particularly <15 mm and preferably ≦10 mm. If the steam blow device includes a steam blow pipe its orifices can be advantageously located from each other at a distance of <20 mm, particularly <10 mm and preferably <7.5 mm.

The steam blow device includes at least one steam blow box, by which the moisture profile of the fibrous web can advantageously be adjusted and/or regulated through it.

The steam blow device includes at least one steam blow pipe, by which the dry content of the fibrous web can be influenced or adjusted and/or regulated at least essentially through the steam blow pipe.

The steam blow device may include either, only at least one steam blow box or only at least one steam blow pipe, or at least one steam blow box as well as also at least one steam blow pipe.

If the fibrous web is covered by at least one permeable fabric in the area of the upstream drying zone, a doctor blade or similar devices are provided in order to remove the boundary air layer that is carried along by the outer permeable fabric covering the fibrous web before the fabric enters the drying area.

The throughput volume (1/min.) of steam is preferably less than the throughput volume (1/min.) of hot air. Moreover, at atmospheric pressure the throughput volume of steam can advantageously be less than 0.5 times, especially less than 0.3 times and preferably less than 0.2 times the throughput volume of hot air.

The steam causes an increase in the temperature of the fibrous web in order to reduce the viscosity of the water in the fibrous web. To that end the steam in the fibrous web, especially the tissue web must condense so that the appropriate temperature increase can be achieved. This temperature increase is adjusted through an appropriate selection of the correct temperature level for the hot air. The temperature of the hot air treating the fibrous web is adjustable, especially for the purpose of influencing the condensation of the steam in the fibrous web.

If the temperature is too low the steam condenses immediately prior to entering the fibrous web. This is due to the fact that the steam is cooled by the housing of the hot air hood and by the incoming colder fabrics. This could occur especially when using a so-called belt press, since the steam in this case must penetrate two outer fabrics, the outer permeable fabric, in particular the press fabric, and possibly a permeable structured fabric before it enters the fibrous web.

If the fibrous web is covered by a permeable press fabric in the drying zone, then the permeable press fabric has a permeability of >100 cfm, especially >300 cfm, particularly >500 cfm and preferably >700 cfm. (cfm=cubic feet per minute).

If the fibrous web is moved through the drying zone together with a permeable structured fabric, then this preferably has a permeability of >100 cfm, especially 300 cfm, particularly 500 cfm and preferably >700 cfm.

It is also especially advantageous if the fibrous web is covered in the upstream drying zone by a permeable press belt which consists at least essentially of a synthetic material, especially polyamide, polyethylene, polyurethane, etc. According to another embodiment of the present invention the fibrous web can be covered in the upstream drying zone by a permeable press belt which is formed by a metal fabric. Preferably at least one belt which runs through the drying zone together with the fibrous web is pre-heated before the drying zone, viewed in the direction of web travel. This is especially advantageous in the case where a press belt consisting of metal is used. For pre-heating, a steam heating device, an IR heating device and/or a hot water heating device are preferably used. A hot water heating device is advantageous, especially for an inner fabric, such as an additional dewatering fabric that is moved through the drying zone together with the fibrous web.

As already mentioned the boundary layer of air that is carried along on the surface of the outer fabric can advantageously be removed, for example by a doctor blade which is located before the hot air hood and which extends across the width of the hot air hood. This also causes an accordingly higher temperature since the steam is not cooled prior to entering the fibrous web. The hot air temperature can therefore be selected to be a lower temperature.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

The invention is described in further detail below, with reference to design examples and to the drawings.

Corresponding reference characters indicate corresponding parts throughout the several views. The exemplification set out herein illustrates one embodiment of the invention, in one form, and such exemplification are not to be construed as limiting the scope of the invention in any manner.

DETAILED DESCRIPTION OF THE INVENTION

Figure 1:
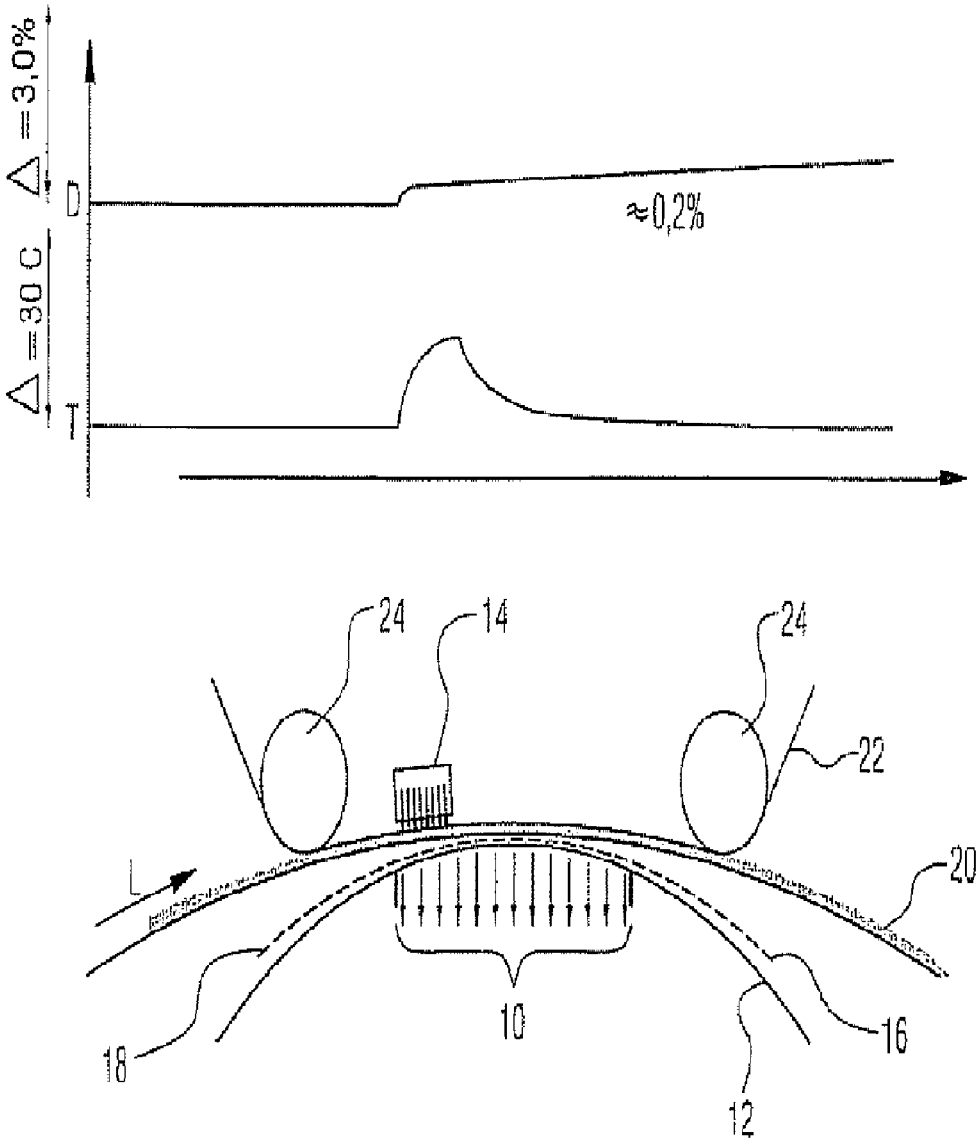
FIG. 1 is a schematic depiction of a conventional drying apparatus which operates with steam only, as well as of the corresponding dry content increase and the corresponding temperature progression.

Referring now to the drawings, and more particularly to FIG. 1, there is shown a schematic depiction of a conventional drying apparatus which operates with steam only and includes a suction roll 12 with a suction zone 10, and a steam blow box 14 in the initial area opposite suction zone 10. A tissue web 16 is guided over suction roll 12 between an inside dewatering fabric 18 or felt 18 and a structured fabric 20, together with an outside press belt 22 which, in this example, is metal. Fabrics 18 and 20 are permeable. Press belt 22 is carried over guide rolls 24 and presses fabrics 18, 20 and 22, as well as tissue web 16 against suction roll 12 in the area of suction zone 10.

The temperature T increases in the area of steam blow box 14. Subsequently however, tissue web 16 cools off drastically inside suction zone 10, with the taken in ambient air. As seen in FIG. 1 a dry content increase of approximately 0.2% occurs, however only in the area of steam blow box 14.

Figure 2:
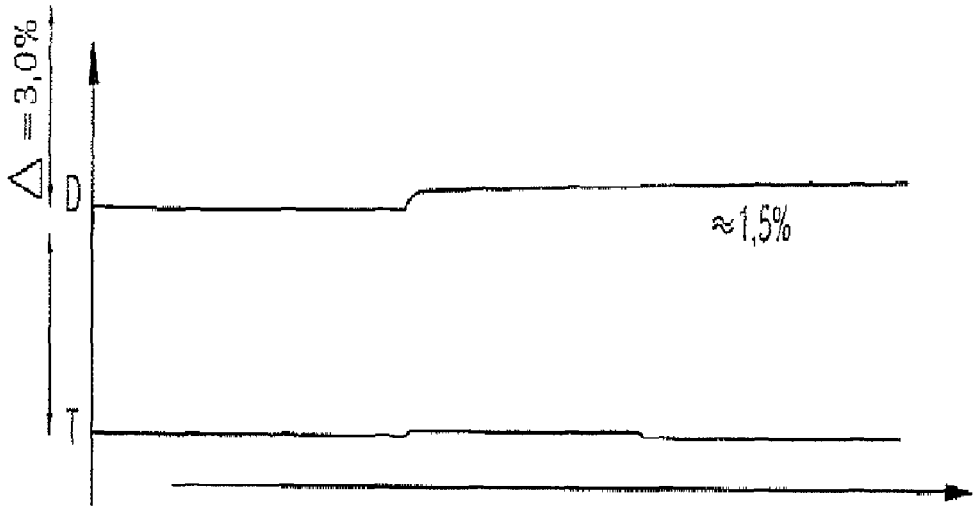
FIG. 2 is a schematic depiction of a conventional drying apparatus which operates only with hot air, as well as of the corresponding dry content increase and the corresponding temperature progression.
Figure 2:
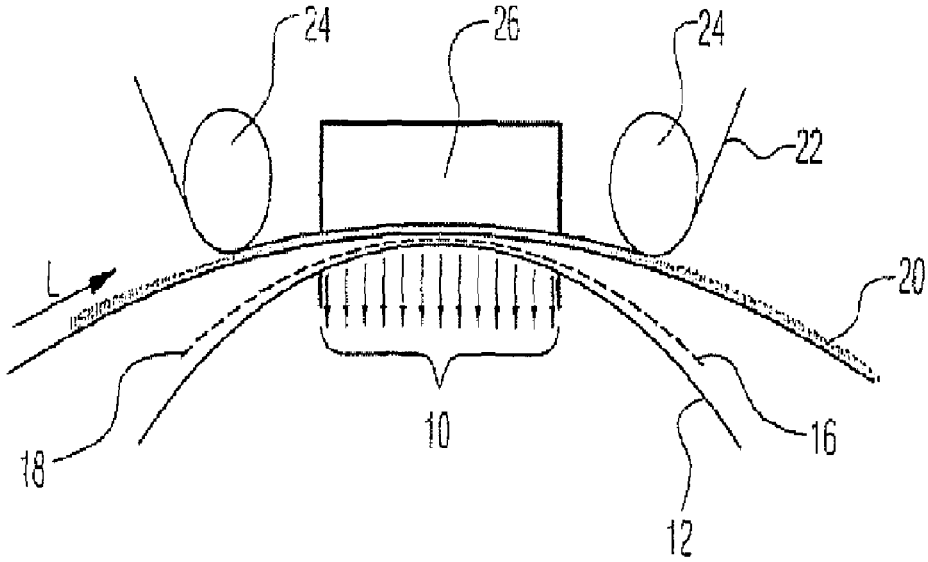

Now, additionally referring to FIG. 2 there is shown a schematic depiction of a conventional drying apparatus which operates with hot air only. This drying apparatus includes a suction roll 12 with a suction zone 10 and a hot air hood 26 opposite suction zone 10 which extents across its entire width when viewed in the direction of web travel L. Tissue web 16 is again carried over suction zone 10 of suction roll 12 between a permeable dewatering fabric 18 or felt and a permeable structured fabric 20, together with a outside permeable metal press belt 22.

With this drying apparatus in which tissue web 16 is dried by hot air flowing through it, the dry content increase D, amounts to approximately 1.5%. The temperature T increases only insignificantly in the area of suction zone 10 and hot air hood 26.

Figure 3:
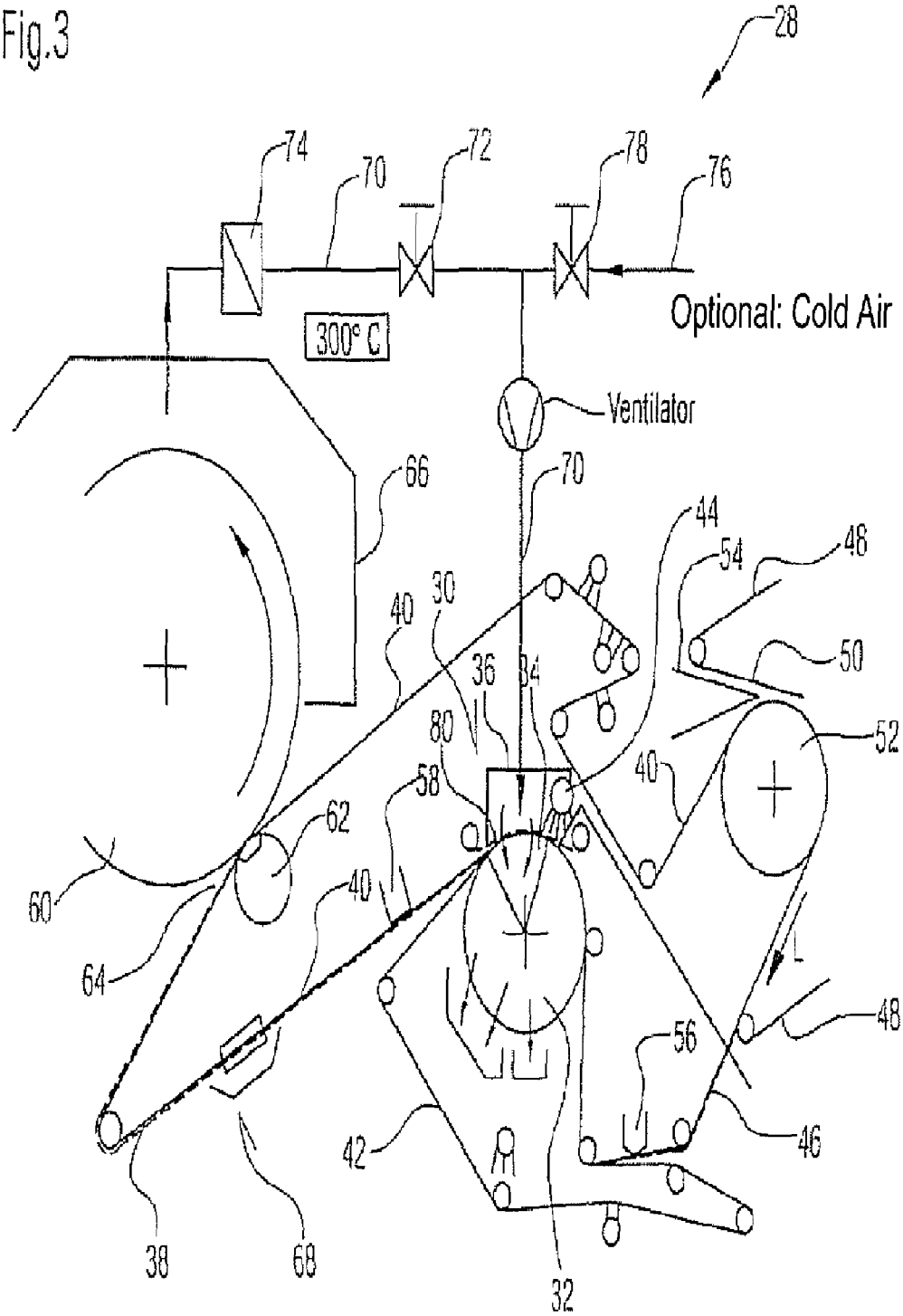
FIG. 3 is a schematic depiction of an example of a design variation of an embodiment of a machine for the production of a tissue web, including a drying apparatus of the present invention.

Now, further referring to FIG. 3 there is shown a schematic depiction of an embodiment of an inventive machine 28 for the production of a fibrous web 38, in this case for example a tissue web 38, with an inventive drying apparatus 30. Drying apparatus 30 includes a suction roll 32 with a suction zone 34 which is defined especially by an integrated suction box, and a hot air hood 36 which is allocated to suction roll 32.

Fibrous web 38, here for example a tissue web 38, is routed over suction roll 32 together with a permeable structured fabric 40, whereby fibrous web 38 is located between permeable structured fabric 40 and suction roll 32. In addition, a permeable press belt 80, which is under high pressure, is wrapped around suction roll 32 on the outside in the area of suction zone 34, thereby creating a belt press 80. Press belt 80, which is merely indicated in FIG. 1, is more clearly recognizable in FIG. 4. The hot air flows from hot air hood 36 successively through permeable press belt 80, permeable structured fabric 40 and fibrous web 38 into suction zone 34 of suction roll 32.

In addition, a dewatering fabric 42, for example a felt, which is located between suction roll 32 and permeable structured fabric 40 and through which the hot air flows into suction zone 34 of suction roll 32 can be guided around suction roll 32. In the present example the hot air flows successively through permeable press fabric 80, permeable structured fabric 40, fibrous web 38 and dewatering fabric 42.

The moving fibrous web 38 is therefore treated with hot air, in the area of drying apparatus 30 by way of an upstream drying zone. This drying zone is defined at least essentially by hot air hood 36. Moreover, this drying zone can extend, for example, at least essentially over suction zone 34 of the suction roll 32, or for example also beyond it, viewed in the direction of web travel L.

Subsequent to the upstream drying zone, which is provided in the area of drying apparatus 30, fibrous web 38 is carried to a downstream drying cylinder 60, especially a Yankee-Cylinder 60 to which an additional hood 66 is allocated and in whose area fibrous web 38 is dried further.

According to the present invention the hot air for hot air hood 36 which is allocated to the upstream drying zone is now recovered, at least partially, from hood 66 which is allocated to the downstream drying cylinder 60. The hot air for hot air hood 36 which is allocated to the upstream drying zone is recovered, at least partially, from the exhaust air of hood 66 allocated to downstream drying cylinder 60.

Drying air from a separate drying air source can also be supplied to hot air hood 36 which is allocated to the upstream drying zone. This drying air supplied to the hot air hood 36 is heated by way of a heat exchanger with hot air which is recovered from hood 66 or its exhaust air, allocated to drying cylinder 60. The hot air recovered from hood 66 of drying cylinder 60 can have a temperature of, for example, approximately 300° C.

Hot air hood 36 is supplied, at least partially, with hot air whose temperature is <250° C., especially <200° C. and preferably in a range of approximately 150° C. to approximately 200° C.

Fibrous web 38 is preferably treated with hot air in the area of the drying zone upstream of drying cylinder 60, and at least in some areas treated with steam. To this end fibrous web 38 may be treated with steam at least at the beginning of the drying zone, viewed in the direction of web travel L. In the present example, according to FIG. 3, and viewed in direction of web travel L, the fibrous web 38 is treated only at the beginning of this drying section with steam. Viewed in the direction of web travel it is initially treated with steam and subsequently with hot air.

At least one steam blow device 44, such as a steam blow pipe or steam blow box is provided for treatment of fibrous web 38 with steam. In the present example steam blow device 44 includes a steam blow pipe, located preferably at the beginning of the drying zone. Steam blow device 44 can extend preferably, at least essentially across the entire width of hot air hood 36, measured across the direction of web travel L. Advantageously it is at least partially located inside hot air hood 36.

Figure 4:
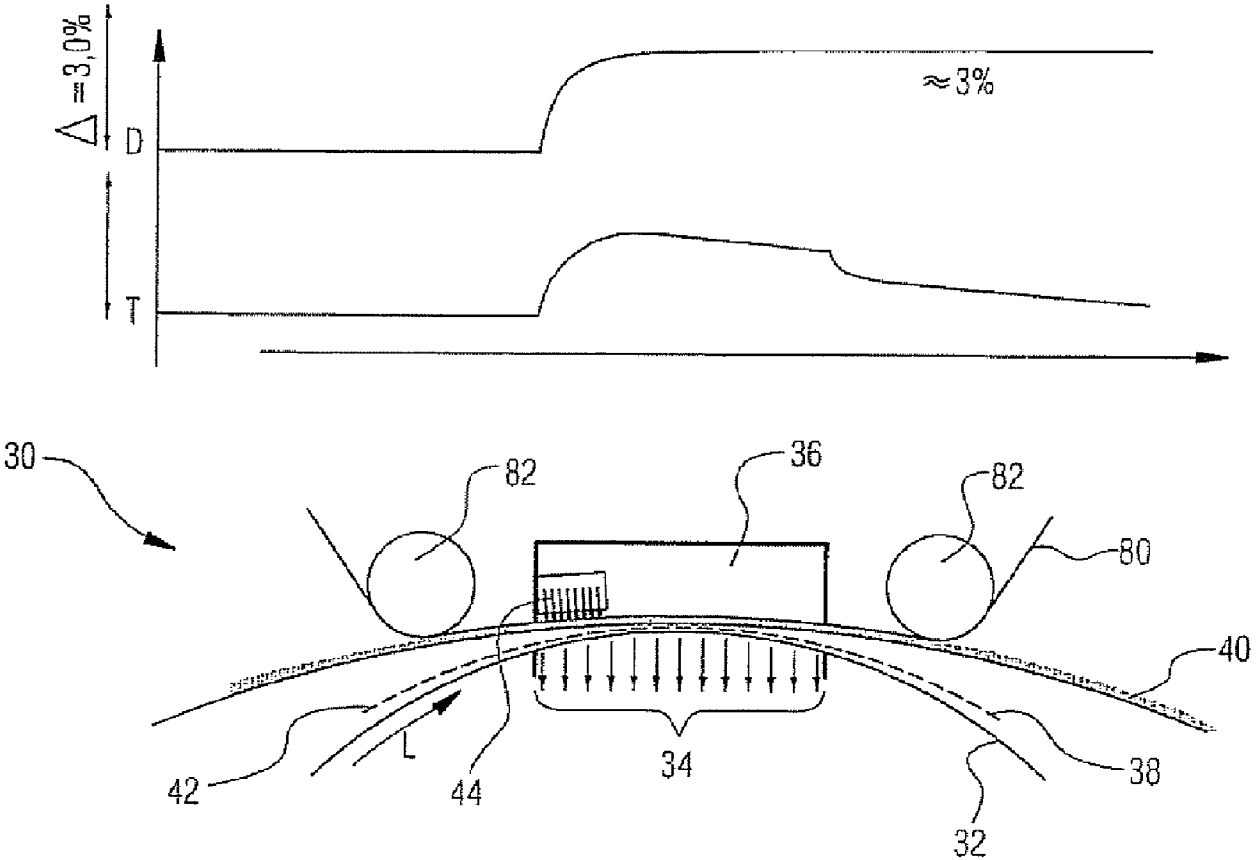
FIG. 4 is a simplified schematic depiction of a modified design variation of the inventive drying apparatus; as well as of the corresponding dry content increase, and the corresponding temperature progression of the web.

As can be seen in the example depicted in FIG. 4, steam blow device 44 may also include, at least one steam blow box. In this case the steam blow box is located again at the beginning of the drying zone, which is defined substantially by hot air hood 36 and is located substantially inside hot air hood 36. Therefore, in this arrangement too, fibrous web 38 is initially treated with steam and subsequently with hot air.

As can be seen in FIG. 3, a doctor blade 46 or similar devices are provided in order to remove the boundary layer of air which is carried along by the outer permeable structured fabric 40 covering fibrous web 38, before fabric 40 enters into the drying zone.

In addition machine 28 includes a former with two dewatering fabrics 40 and 48 running together, whereby the inside fabric is also permeable structured fabric 40. The two dewatering fabrics 40 and 48 run together, thereby forming a stock infeed nip 50 and are carried over a forming element 52, especially a forming roll.

In the example permeable structured fabric 40 is in the embodiment of the inside dewatering fabric of the former which is in contact with forming element 52. Outside dewatering fabric 48, which is not in contact with forming element 52, is separated again from fibrous web 38 subsequent to forming element 52. The fibrous stock suspension is fed into the stock infeed nip 50 by way of a headbox 54.

A suction element 56 is provided between forming element 52 and drying apparatus 30, through which fibrous web 38 is held on permeable structured fabric 40 or, it is pressed against permeable structured fabric 40.

After drying apparatus 30, dewatering fabric 42 is again separated from permeable structured fabric 40. Moreover, a pickup or separation element 58 is provided after drying apparatus 30 through which fibrous web 38 is held to permeable structured fabric 40 during the separation from dewatering fabric 42.

Subsequent to this e fibrous web 38, together with permeable structured fabric 40, is run through a press nip 64 which is formed preferably by a drying cylinder 60 in the embodiment of a Yankee-Cylinder 60 and a press element 62, for example a press roll 62. In the present invention press element 62 is a shoe press roll 62. Following press nip 64 permeable structured fabric 40 is separated again from drying cylinder 60 while fibrous web 38 remains on drying cylinder 60. A hood 66 is allocated to the drying cylinder 60. A vacuum box with a hot air hood 68 is provided between suction roll 32 and drying cylinder 60, in order to increase the sheet rigidity.

As already mentioned, the hot air for hot air hood 36, which is allocated to suction roll 32, can be recovered, at least partially, from hood 66, which is allocated to drying cylinder 60. The hot air recovered from hood 66 has a temperature in the range of approximately 300° C. which, as a rule, is higher than that which is required for the hot air of hot air hood 36.

As can be seen in FIG. 3 the hot air recovered from hood 66 which is allocated to the drying cylinder can be supplied to hot air hood 36 via a supply line 70 in which at least one valve 72, especially a control valve 72 can be located. In addition a filter 74 may also be provided in supply line 70 for the removal of short fibers, dust or similar substances. Finally, a ventilator may also be located in supply line 70.

The hot air recovered from hood 66 which is allocated to cylinder 60 can also be mixed with cold air that is supplied through a line 76. Also in line 76 a valve 78, especially a control valve, is provided for the cold air that is to be supplied. The temperature of the air supplied to hot air hood 36 can therefore be adjusted through the mixing ratio of the hot air recovered from hood 66 and cold air.

An arrangement (not shown) is also conceivable in which the hot air for the hot air hood which is allocated to the upstream drying zone is supplied through a separate drying air source, whereby the drying air supplied through this separate source can be heated by way of a heat exchanger through the exhaust air of hood 66 which is allocated to drying cylinder 60. No filter is required for this arrangement.

FIG. 4 shows a simplified depiction of a modified design variation of the present inventive drying apparatus 30. As already mentioned, in this arrangement steam blow device 44 includes a steam blow box located at least essentially inside hot air hood 36, in place of the steam blow pipe. Viewed in the direction of web travel L this steam blow box is located at the beginning of the drying zone which is defined here, at least essentially, by hot air hood 36.

The present design example distinguishes itself from that in FIG. 3 in that in addition to permeable structured fabric 40 and dewatering fabric 42 or felt a permeable press belt 80 is routed through the drying zone together with fibrous web 38, such that permeable structured fabric 40, fibrous web 38 and permeable dewatering fabric 42 are pressed against the suction roll in the area of suction zone 34.

Viewed in the direction of web travel L dewatering fabric 18 is routed around a guide roll before and after the drying zone respectively through which the appropriate tension for press belt 80 is produced.

As can be seen in FIG. 4, a relatively high temperature T occurs opposite the entire suction zone which in this arrangement also defines the drying zone. Accordingly, a relatively high dry content increase also occurs, in this instance approximately 3%.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

10 Suction zone
12 Suction roll
14 Steam blow box
16 Tissue web
18 Dewatering fabric
20 Structured fabric
22 Press belt
24 Guide roll
26 Hot air hood
28 Machine
30 Drying apparatus
32 Suction equipped device, suction roll
34 Suction roll
36 Hot air hood
38 Fibrous web, especially tissue web
40 Permeable structured fabric
42 Dewatering fabric
44 Steam blow device, steam blow pipe, steam blow box
46 Doctor blade
48 Dewatering fabric
50 Stock infeed nip
52 Forming element, forming roll
54 Headbox
56 Suction element
58 Pickup or separation element
60 Drying cylinder, Yankee-Cylinder
62 Press element
64 Press nip
66 Hood
68 Hot air hood
70 Supply line
72 Valve
74 Filter
76 Line
78 Valve
80 Permeable press belt
82 Guide roll

What is claimed is:

1. A method for drying a fibrous web, the fibrous web being one of a paper, a cardboard and a tissue web, the method comprising the steps of:

treating the moving fibrous web with hot air from a hot air hood in an area of a upstream predefined drying zone; and carrying the fibrous web subsequent to the drying zone to a downstream drying cylinder to which an additional hood is allocated and in whose area the fibrous web is dried further, the drying cylinder being downstream from the upstream drying zone; and recovering the hot air for said hot air hood which is allocated to the upstream drying zone at least partially from said additional hood, the hot air for the hot air hood which is allocated to the upstream drying zone is at least partially recovered from exhaust air of the additional hood which is allocated to the downstream drying cylinder.

2. The method of claim 1, wherein said drying cylinder is a Yankee-Cylinder.

3. The method of claim 1, further comprising the step of supplying drying air from a separate drying air source to the hot air hood allocated to the upstream drying zone, the drying air supplied to the hot air hood is heated by way of a heat exchanger with hot air which is recovered from one of the additional hood and exhaust air from the additional hood allocated to the drying cylinder.

4. The method of claim 3, wherein the hot air recovered from the additional hood of the drying cylinder has a temperature of approximately 300° C.

5. The method of claim 4, wherein the hot air hood is supplied at least partially with hot air whose temperature is <250° C.

6. The method of claim 5, wherein said temperature is <200° C.

7. The method of claim 6, wherein said temperature is in a range of approximately 150° C. to approximately 200° C.

8. The method of claim 1, further comprising the step of treating the fibrous web with steam at least in some areas within the drying zone.

9. The method of claim 8, wherein the fibrous web is treated with steam within the first half of a total length of the drying zone when viewed in a direction of web travel.

10. The method of claim 9, wherein the fibrous web is treated with steam at least at the beginning of the drying zone as viewed in the direction of web travel.

11. The method of claim 10, wherein the fibrous web is initially treated with steam and subsequently with hot air as viewed in the direction of web travel.

12. The method of claim 1, wherein the fibrous web is treated initially with hot air, subsequently with steam and then again with hot air when viewed in a direction of web travel.

13. The method of claim 1, wherein the fibrous web is treated substantially over the entire length of the drying zone with steam.

14. The method of claim 1, wherein the fibrous web is treated with steam substantially only within the first half of the total length of the drying zone viewed in a direction of web travel.

15. The method of claim 14, wherein the fibrous web is treated with steam substantially over the first half of the total length of the drying zone as viewed in the direction of web travel.

16. The method of claim 1, wherein the fibrous web is treated with steam substantially only within the first third of the total length of the drying zone viewed in a direction of web travel.

17. The method of claim 16, wherein the fibrous web is treated with steam substantially over the first third of the total length of the drying zone as viewed in the direction of web travel.

18. The method of claim 1, wherein the fibrous web is treated with steam substantially only within the first quarter of the total length of the drying zone viewed in a direction of web travel.

19. The method of claim 18, wherein the fibrous web is treated with steam substantially over the first quarter of the total length of the drying zone as viewed in the direction of web travel.

20. The method of claim 1, wherein the fibrous web is treated with steam only at the beginning of the drying zone as viewed in the direction of web travel.

21. The method of claim 1, wherein the fibrous web is treated with hot air over the predefined drying zone.

22. The method of claim 1, wherein the fibrous web is treated in at least some areas simultaneously with hot air and with steam.

23. The method of claim 1, further comprising the step of carrying the fibrous web through the drying zone together with a permeable fabric, the permeable fabric being one of a structured fabric and a through air drying fabric, one of hot air and steam flow first through the fibrous web and subsequently through the permeable fabric.

24. The method of claim 23, wherein the fibrous web is carried through the drying zone together with the structured fabric and at least one of the hot air and the steam flow initially through the permeable fabric and subsequently through the fibrous web.

25. The method of claim 23, wherein in the drying zone the fibrous web is covered by at least one additional permeable fabric, the at least one additional permeable fabric being a press belt, at least one of the hot air and the steam flowing initially through the additional permeable fabric, subsequently through the first permeable fabric and finally through the fibrous web.

26. The method of claim 25, wherein a dewatering fabric, the dewatering fabric being a felt, is additionally run through the drying zone together with the fibrous web, at least one of the hot air and the steam initially flow through the additional permeable fabric, subsequently through the first permeable fabric, then the fibrous web and finally through the dewatering fabric.

27. The method of claim 1, wherein the fibrous web is subjected in the drying zone in at least some areas to impingement drying.

28. The method of claim 1, wherein the fibrous web is subjected in the drying zone in at least some areas to through-air drying.

* * * * *

UNITED STATES PATENT AND TRADEMARK OFFICE

CERTIFICATE OF CORRECTION

PATENT NO. : 8,402,673 B2
APPLICATION NO. : 12/487344
DATED : March 26, 2013
INVENTOR(S) : Luiz C. Da Silva et al.

It is certified that error appears in the above-identified patent and that said Letters Patent is hereby corrected as shown below:

On the Title Page
Item (63)
Under Related U.S. Application Data, please delete "Dec. 22, 2006", and substitute therefore --Dec. 20, 2007--.

Signed and Sealed this
Sixteenth Day of December, 2014

Michelle K. Lee

Michelle K. Lee
*Deputy Director of the United States Patent and Trademark Office*